US006209157B1

(12) United States Patent
Hensley

(10) Patent No.: US 6,209,157 B1
(45) **Date of Patent: *Apr. 3, 2001**

(54) ARTICULATING BED FRAME

(75) Inventor: David W. Hensley, Milan, IN (US)

(73) Assignee: PaTMark Company, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/396,033

(22) Filed: Sep. 15, 1999

Related U.S. Application Data

(63) Continuation of application No. 09/064,292, filed on Apr. 22, 1998.

(51) Int. Cl.[7] ..... A47B 7/02
(52) U.S. Cl. ..... 5/618; 5/613; 5/617
(58) Field of Search ..... 5/613, 617, 616, 5/618, 620, 915, 933

(56) References Cited

U.S. PATENT DOCUMENTS

| | | | | |
|---|---|---|---|---|
| 3,565,501 | | 2/1971 | Bowen et al. . | |
| 3,593,350 | | 7/1971 | Knight et al. . | |
| 3,821,821 | | 7/1974 | Burst et al. . | |
| 3,898,702 | | 8/1975 | Goodman . | |
| 4,271,830 | | 6/1981 | Moon . | |
| 4,361,917 | | 12/1982 | Wilson . | |
| 4,381,571 | | 5/1983 | Elliott . | |
| 4,385,410 | | 5/1983 | Elliott et al. . | |
| 4,407,030 | | 10/1983 | Elliott . | |
| 4,435,862 | | 3/1984 | King et al. . | |
| 4,912,789 | * | 4/1990 | Maxwell | 5/915 X |
| 5,007,410 | * | 4/1991 | DeLaney | 5/915 X |
| 5,257,428 | | 11/1993 | Carroll et al. . | |
| 5,468,216 | * | 11/1995 | Johnson et al. | 5/616 X |
| 5,494,333 | | 2/1996 | Wilson . | |
| 5,502,849 | | 4/1996 | Mitchell . | |
| 5,537,701 | | 7/1996 | Elliott . | |
| 5,577,279 | | 11/1996 | Foster et al. . | |
| 5,577,280 | | 11/1996 | Elliott . | |
| 5,579,550 | | 12/1996 | Bathrick et al. . | |
| 5,600,214 | | 2/1997 | Fromson . | |
| 5,608,932 | | 3/1997 | Hasegawa . | |
| 5,640,730 | | 6/1997 | Godette . | |
| 5,680,661 | | 10/1997 | Foster et al. . | |
| 5,682,629 | | 11/1997 | Bortoluzzi . | |
| 5,740,568 | | 4/1998 | Elliott . | |
| 5,870,784 | | 2/1999 | Elliott . | |

FOREIGN PATENT DOCUMENTS

| | | |
|---|---|---|
| 1230059 | 4/1971 | (GB) . |

* cited by examiner

*Primary Examiner*—Terry Lee Melius
*Assistant Examiner*—James M Hewitt
(74) *Attorney, Agent, or Firm*—Barnes & Thornburg

(57) ABSTRACT

The bed frame includes a base frame and an articulating upper frame. The base frame includes a head end, a foot end, and oppositely disposed, longitudinally extending sides. The articulating upper frame comprises an upper body section, a seat section, a thigh section, and a lower leg section. The articulating upper frame is mounted on the base frame for longitudinal shifting of the articulating upper frame relative to the base frame. A first drive assembly for raising and lowering the upper body section includes linkage connected to the upper body section such that, tilting movement of the upper body section shifts the articulating upper frame longitudinally relative to the base frame. A second drive assembly for raising and lowering the thigh section includes linkage connected to the lower leg section such that, when the thigh section tilts upwardly, the lower leg section tilts downwardly. In accordance with further aspects of the present invention, a drive assembly for longitudinal shifting of the upper frame relative to the base frame includes linkage connected to the upper body section such that longitudinal shifting of the upper frame relative to the base frame results in tilting movement of the upper body section.

25 Claims, 12 Drawing Sheets

ARTICULATING BED FRAME

BACKGROUND AND SUMMARY OF THE INVENTION

This is a continuation application of a U.S. patent application, Ser. No. 09/064,292, filed on Apr. 22, 1998, entitled "Articulating Bed Frame", and assigned to the same assignee as the present assignee, which patent application is hereby incorporated by reference.

The present invention relates to articulating bed frames and more particularly to the provision of articulating bed frames which will move rectilinearly toward the wall or the stationary headboard when the upper body portion of the bed is tilted upwardly, move rectilinearly toward the foot of the bed when the upper body portion is tilted downwardly, and which can also be moved into a purchaser's home by one delivery person and assembled by that delivery person.

Articulating bed frames are known and are often referred to as "hospital bed" frames in that the frames provide relatively movable upper body portions, seat portions, thigh portions and lower leg portions. Such beds are described in U.S. Pat. No. 5,815,865. In such beds, the head and upper back of the person reclining on the bed may be tilted upwardly from the transversely extending seat panel to a selected position. Generally the transversely extending seat panel remains stationary and flat. The thigh section tilts upwardly from the seat panel to raise the patient's knees and thighs. The lower leg panel then tilts downwardly from the thigh panel in conventional fashion.

It is desirable to have such an articulating frame which is shipped in semi-knocked down (SKD) condition for ease of handling, transportation and assembly in the field. Only one delivery person is required to take such a SKD articulating frame to a customer's home to be installed. It is also desirable to have such an articulating frame which will move rectilinearly toward the head of the bed when the head portion is raised and toward the foot of the bed when the head portion is lowered. This will permit the bed to be placed against a wall or a stationary headboard. It will also permit the person on the bed to stay close to the adjacent night stand when the head portion is tilted upwardly.

In accordance with the present invention, such an articulating frame can be set up on a conventional metal bed frame, inside a conventional water bed or inside a conventional sleigh frame which includes fixed headboards and footboards with side rails therebetween. Such an articulating frame fits a marketing paradigm of providing an adjustable frame to go on a conventional bed frame to replace the conventional box spring. An embodiment of the present invention is established to fit on a variety of frames defined by industry standards. While it may be known to have such add-on frames, it is not known to provide such an add-on articulating frame which moves rectilinearly toward and away from the wall or the stationary headboard, which includes removable panels in each of the support sections of the frame, and which is shipped in SKD form.

One embodiment of the invention, therefore, comprises a two-part articulating bed frame which will fit on a conventional bed frame, have articulating panel sections movable with respect to such conventional bed frames, and be delivered and installed by one person. This embodiment includes a base frame which is a weldment that moves separately from the articulating upper frame and which includes, at each of its longitudinally extending sides, inwardly facing channels serving as guide tracks. The channels are connected by longitudinally spaced apart, transversely extending struts such that the assembly becomes rigid, but lightweight and easy to transport. The inwardly facing channels serve as tracks or guides for rollers which accommodate the longitudinally directed, rectilinear movement of the upper frame.

Essentially, the upper frame is a hinged frame providing an upper body frame section, a seat frame section, a thigh frame section, and a lower leg frame section. These frame sections are longitudinally spaced apart and transversely extending in conventional fashion. Adjacent frame sections may be hinged together to provide for articulating movement of at least the upper body, thigh and lower leg frame sections. The seat section is conventionally not an articulating section and stays flat or horizontal. It is on this seat section that the control for the drive mechanisms for the upper body frame section and thigh frame section may be provided. Typically these drive mechanisms may be conventional electric motor and screw arrangements. Appropriate linkages to be described hereinafter are provided for controlling relative movement of the upper body frame section relative to the base frame and also for controlling relative movement of the thigh and lower leg sections.

In accordance with the present invention, the upper frame is formed with inwardly and upwardly opening angles for receiving removable panels. The articulating frame of the present invention comprises four separate removable panels which are received in their respective frame sections to provide a platform for supporting a mattress. These panels may be some type of lightweight, rigid wood-product members, the upper surfaces of which may be coated or covered with a decorative pattern or material. By having these removable panels, the upper frame is much easier to deliver and install. In addition, all of the electrical controls and the drive mechanisms for the articulating frame may be mounted on the underside of the seat panel.

While one embodiment of the present invention is designed to be placed on top of a conventional bed frame to replace a conventional box spring, the present invention also contemplates a stand-alone frame assembly which can be taken apart and delivered in pieces by a single delivery person. In this embodiment of the present invention, a floor engaging base frame including four corner posts, longitudinally extending side rails and transversely extending end rails is provided. This floor engaging base frame may include adjustable corner posts or legs comprising, at each corner, an outer, vertically extending sleeve and an inner sleeve telescoped in the outer sleeve to move downwardly to an adjusted position to establish the height of the bed. The outer and inner telescopic sleeves may have longitudinally spaced apart openings through which adjustment pins can be inserted to select the height of the floor engaging base frame. The inner sleeve may carry at its lower end a roller caster or an isolation pad or, for that matter, a roller caster which is connected to the inner sleeve by means of an isolation pad. The isolation pads will be particularly helpful if the mattress placed on the frame assembly has a vibration massage capability.

Further, in this embodiment, the channel tracks are provided in the side rails of the floor engaging base frame. Then, the articulating upper frame with its pop-out panels as described above is mounted atop the floor engaging base frame for rectilinear movement.

In still a further embodiment of the present invention, the floor engaging base frame with channel tracks is positioned inside a conventional bed frame or inside a conventional sleigh frame. A carriage is mounted on the floor engaging base frame for longitudinal motion. An upper deck comprising a set of four longitudinally spaced apart and transversely extending panel sections is mounted on the carriage. The panel sections are hinged together to provide for articulating movement of at least the upper body, thigh and lower leg panel sections. The seat panel section is bolted to the carriage, and remains stationary and flat. These panels may be some type of lightweight, sturdy, rigid wood-product members, such as Oriented Strand Board or OSB.

The present invention, therefore, is a bed frame including a base frame and an articulating upper frame. The base frame comprises a head end, a foot end and oppositely-disposed longitudinally extending sides. An articulating upper frame or deck comprises an upper body section, a seat section, a thigh section and a lower leg section. These sections are longitudinally spaced apart and transversely extended, and at least the upper body, thigh and lower leg sections are movable with respect to the seat section to provide for articulating movement. The upper frame is mounted on the base frame for longitudinal shifting of the upper frame relative to the base frame. A drive assembly for raising and lowering the upper body section relative to the base frame includes linkage connected to the upper body section such that, tilting movement of the upper body section shifts the upper frame longitudinally relative to the base frame. When the upper body section is tilted upwardly, the upper frame shifts longitudinally toward the head end of the bed and when the upper body section tilts downwardly, the upper frame shifts longitudinally toward the foot end of the bed. A second drive assembly for raising and lowering the thigh section relative to the base frame includes linkage connected to the lower leg section such that, when the thigh section is tilted upwardly, the lower leg section is tilted downwardly.

Additional features, and advantages of the present invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
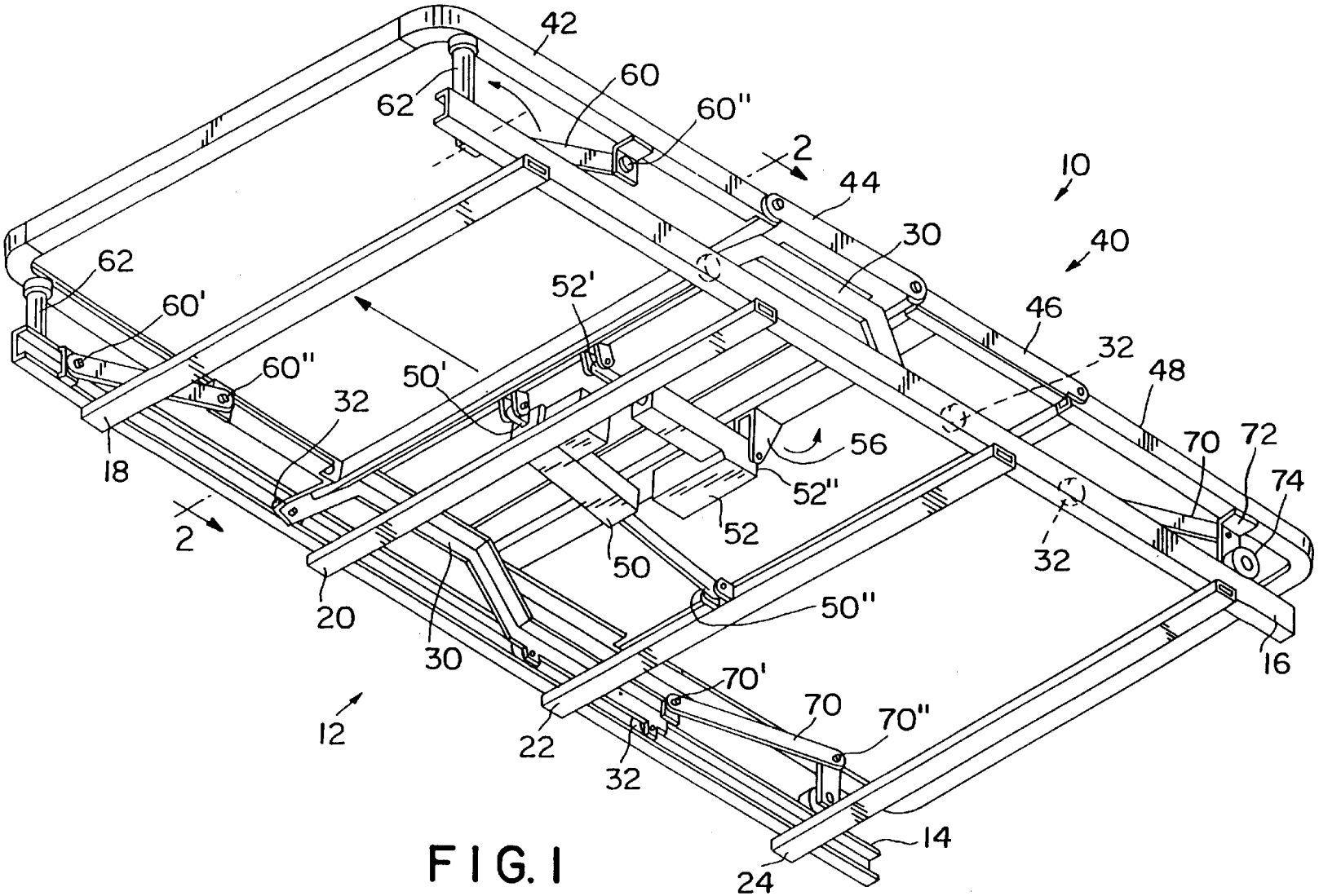
FIG. 1 is a bottom, left and front perspective view of one embodiment of the present invention showing a multi-part SKD frame assembly comprising a base frame which is mountable on a conventional bed frame, a carriage mounted on the base frame for rectilinear motion and an articulating upper frame mounted on the carriage, FIG. 1*a* diagrammatically shows the pop-out panels or decks arranged for reception in the articulating upper frame to form a platform for a mattress, FIG. 1*b* diagrammatically shows electrical hand controls for operating first and second drives for lifting and lowering the upper body frame section and for lifting and lowering the thigh and lower leg frame sections respectively.

The frame assembly 10 shown in FIG. 1 comprises a base frame or channel frame 12 including a pair of inwardly facing, longitudinally extending side rails or channels 14, 16 which are held in laterally spaced apart position by four longitudinally spaced apart, transversely extending strut members 18, 20, 22, 24. The base frame 12 can be picked up and carried by a single delivery person and is designed to be set atop a conventional bed frame in the position that is shown in FIG. 1. A carriage 30 having rollers 32 is mounted on the base frame 12 for rectilinear movement. The inwardly facing channels 14, 16 of the base frame 12 serve as longitudinally extending guides or tracks for rollers 32.

Figure 3:
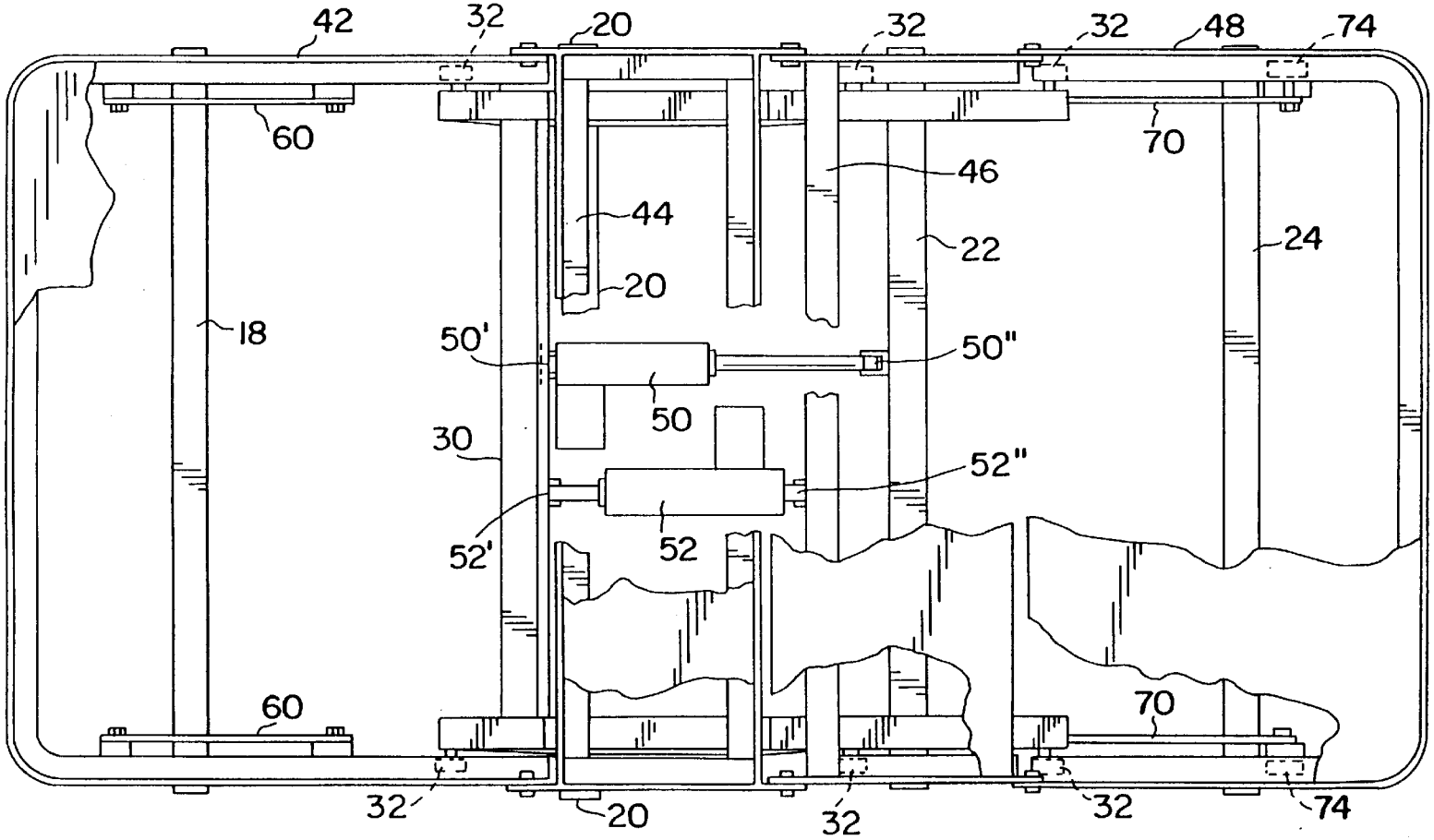
FIG. 3 shows a top view of the FIG. 1 frame assembly showing the base frame, the carriage riding in the base frame and the articulating upper frame mounted on the carriage.
Figure 4:
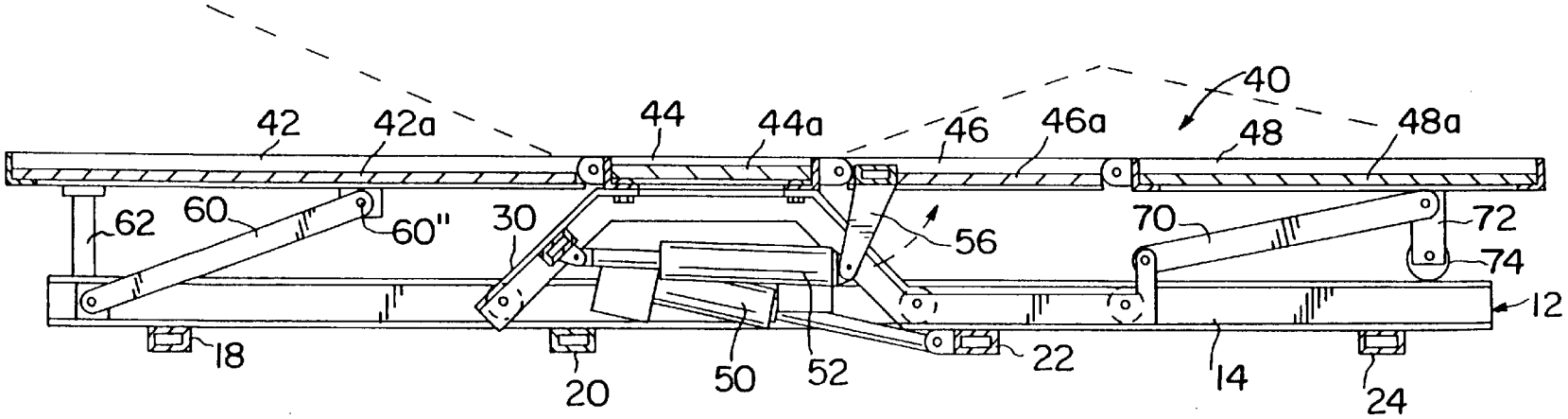
FIG. 4 shows a front sectional view of the FIG. 1 frame assembly with the articulating upper frame disposed in a horizontal position.
Figure 5:
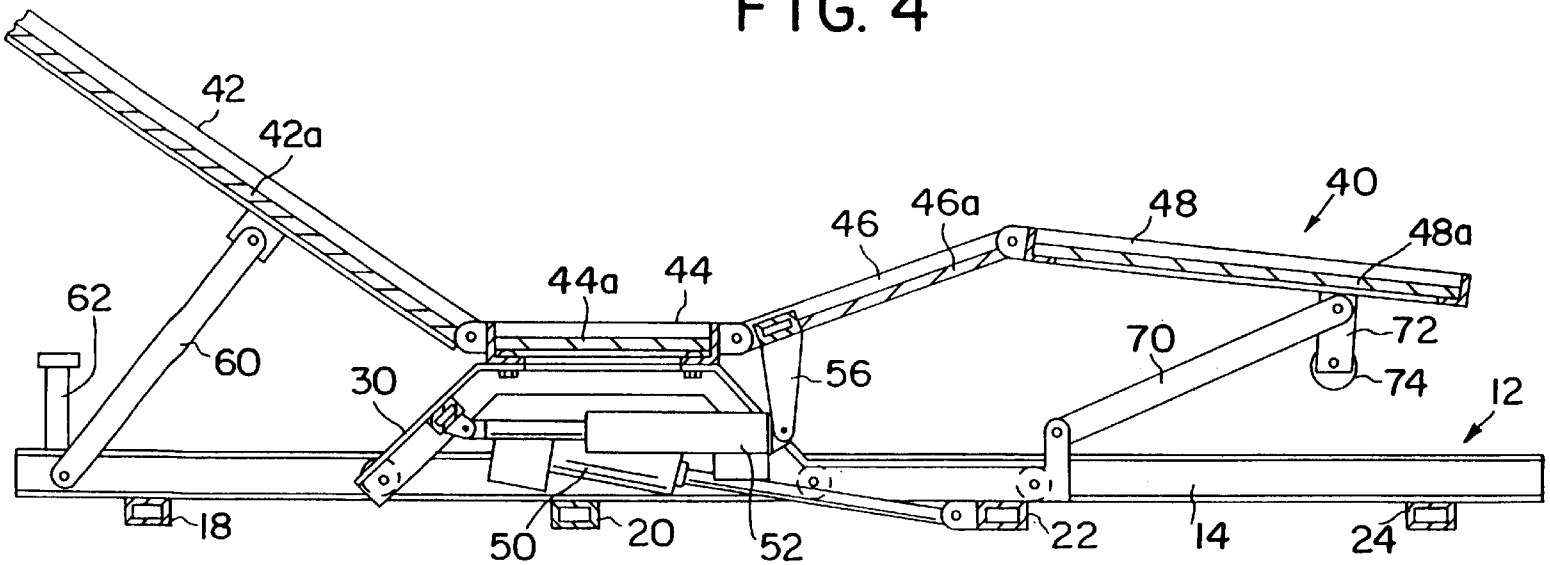
FIG. 5 is a view similar to FIG. 4 of the frame assembly with the upper body frame section and the thigh frame section raised.

An articulating upper frame 40 is mounted on the carriage 30. This articulating frame 40 comprises an upper body frame section 42, a seat frame section 44, a thigh frame section 46 and a lower leg frame section 48. As shown in FIGS. 3–5, these frame sections are fabricated from upwardly and inwardly opening channel members and are hinged together in a conventional manner. Essentially, the upper body frame section 42 and the thigh frame section 46 pivot upwardly from the seat frame section 44 in a conventional manner. When the thigh frame section 46 pivots upwardly, the lower leg frame section 48 tilts downwardly from the thigh frame section in the manner shown in FIGS. 4 and 5.

The base frame 12, the carriage 30 and the articulating upper frame 40 are all made from suitable high strength, lightweight, rigid materials, such as aluminum, steel, high strength plastic or a composite.

Figure 1A:
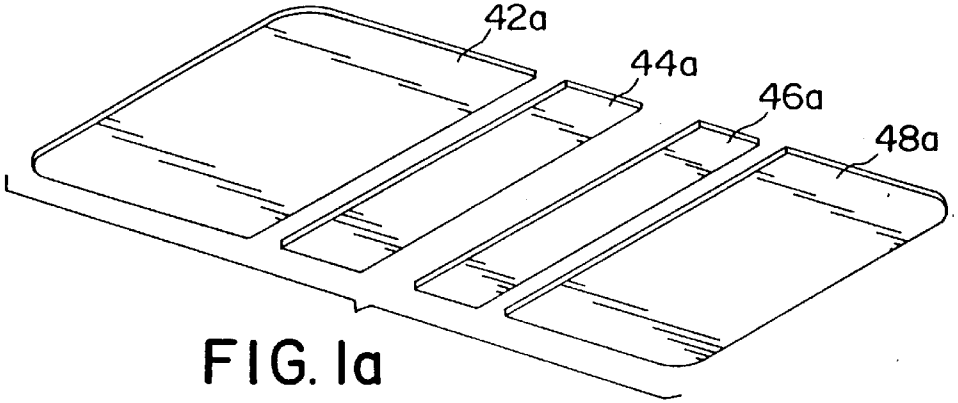

In accordance with the present invention, each of these frame sections 42–48 carries a pop-out panel or deck which is received within the upwardly and inwardly opening channels of the frame section. These pop-out panels are shown in FIGS. 1*a* and identified as panels 42*a*, 44*a*, 46*a* and 48*a* corresponding respectively to the frame sections 42, 44, 46, 48. The panels may be made from any type of rigid lightweight panel material and are conveniently made from plywood, chip board or OSB board very well known in the furniture business. These panels 42*a*, 44*a*, 46*a*, 48*a* may be covered with decorative material or somehow coated to have a pleasing appearance. Each panel 42*a*, 44*a*, 46*a* and 48*a* will drop into its respective frame section 42, 44, 46, 48 to be held there by the weight of the panel and any mattress placed on the articulating frame.

Figure 1B:
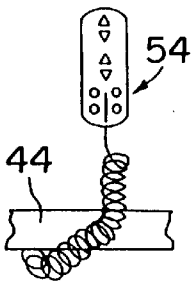
Figure 2:
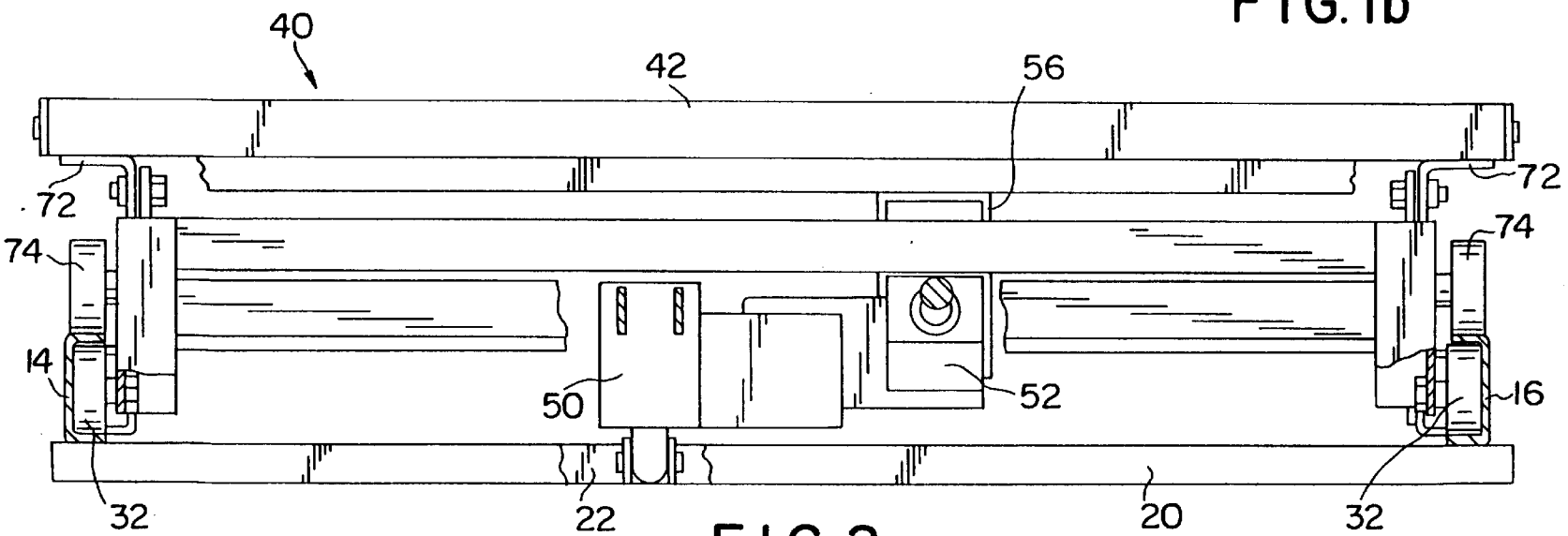
FIG. 2 shows a sectional end view of the FIG. 1 frame assembly, taken along the line 2—2 in FIG. 1, showing the inwardly-facing channels of the base frame, the carriage having rollers riding in the channels, and further showing the first and second drives mounted on the carriage.

The seat frame section 44 is supported by and bolted to the carriage 30 by a set of bolts as shown. The seat frame section 44 may preferably carry the electrical controls for the first and second drive systems 50, 52 that move the upper body frame section 42, the thigh frame section 46 and the lower leg frame section 48 in the manner described below. Alternately, as diagrammatically shown in FIG. 1*b*, a wired remote control unit 54 may be provided for operating the two drive systems. Although a wired remote control unit is shown in FIG. 1*b*, it is contemplated that one may instead use a wireless remote control unit for convenience.

In a conventional fashion, the first drive system 50 is provided for lifting and lowering the upper body frame section 42, and the second drive system 52 is provided for lifting and lowering the thigh frame section 36. These two drive systems 50, 52 may conventionally comprise electrical motors and lead screws such as are conventionally used to drive articulating frame sections. A suitable electrical motor for use with the drive systems 50, 52 is a linear actuator motor, model no. LA 31.1, made by Linak Company of Denmark. It will be appreciated, however, that any number of different type of drive mechanisms may be used in accordance with the present invention. Such systems may include hydraulic systems as well as pneumatic drives. In preferred systems, the person lying on the bed manipulates electrical controls on the hand unit 54 to make the bed move to a more comfortable position.

As shown in FIGS. 1 and 3, the first and second ends 50', 50" of the first drive system 50 are pivotally connected to the carriage 30 and the strut member 22 of the base frame 12, respectively. The first drive system 52 serves to move the carriage 30 longitudinally in the channels 14, 16. Similarly, the first and second ends 52', 52" of the second drive system 52 are pivotally connected to the carriage 30 and a bracket 56 attached to the thigh frame section 46, respectively. The second drive system 52 serves to lift and lower the thigh frame section 46.

The upper body frame section 42 is connected by links 60 to the head ends of the side rails 14, 16 by pins 60', 60". When the carriage 30 moves along the channels 14, 16 toward the headboard, the links 60 cause the upper body frame section 42 to tilt upwardly from its horizontal position. The linkage assembly 60 causes the upper body frame section 42 to move back toward its horizontal position when the carriage 30 moves toward the footboard. A pair of support members 62 are welded to the head ends of the side rails 14, 16 for supporting the upper body frame section 42 when the articulating bed frame 40 is flat or horizontal.

A pair of links 70, 72 are provided for controlling the movement of the lower leg frame section 48 relative to the base frame 12. The first and second ends 70', 70" of the links 70 are pivotally connected to the carriage 30 and the lower leg frame section 48 respectively. A pair of support brackets 72 carrying the rollers 74 are secured to the underside of the lower leg frame section 48. The rollers 74 rest on the side rails 14, 16 when the lower leg frame section 48 is flat. When the thigh frame section 46 is raised by the drive system 52, the links 70 cause the lower leg frame section 48 to pivot downwardly as shown in FIG. 5.

Figure 6:
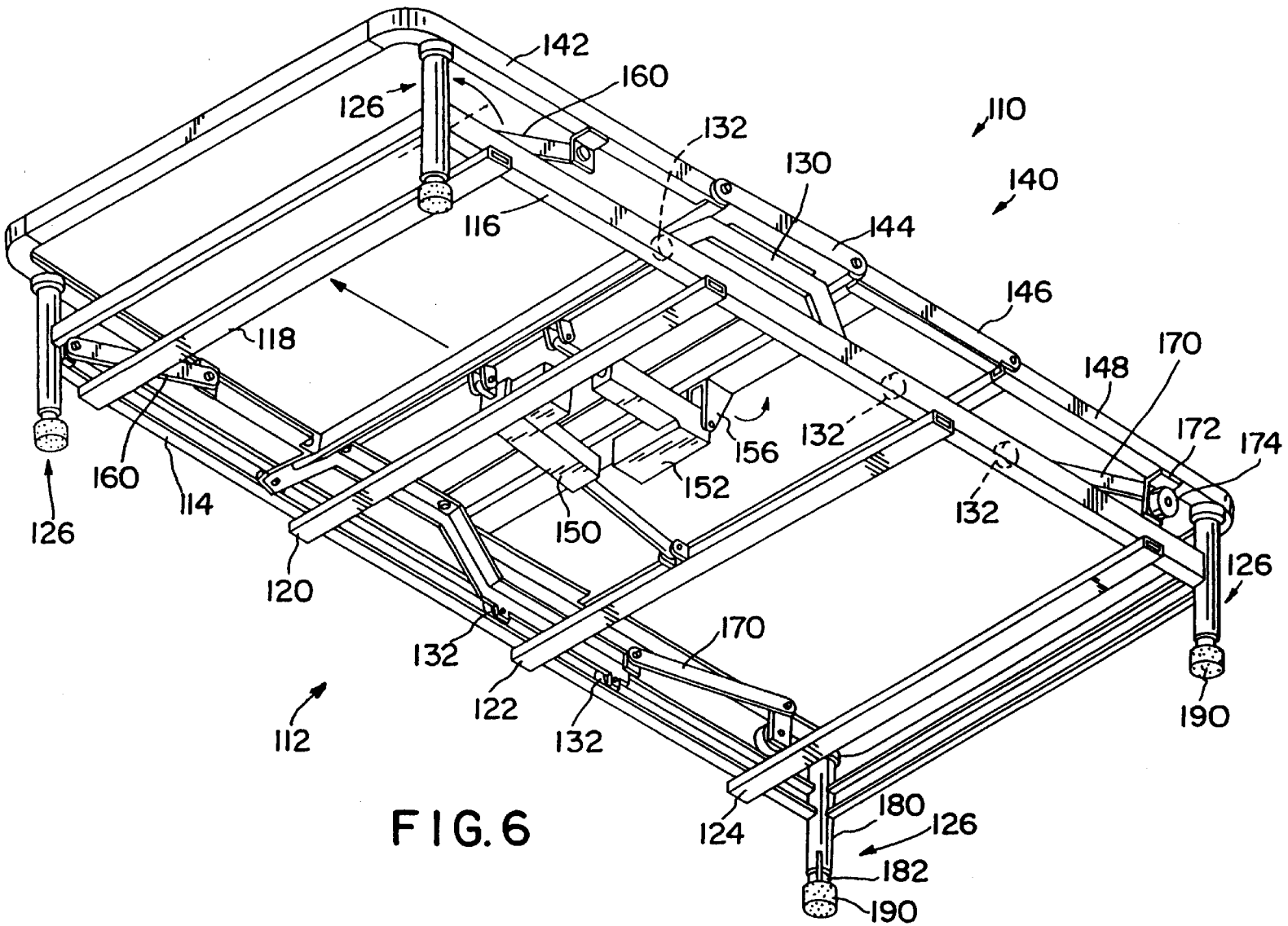
FIG. 6 is a bottom, left and front perspective view of a second embodiment of the present invention, similar to the FIG. 1 embodiment, showing a floor engaging base frame with side rails having channel tracks and four corner posts or legs, a carriage mounted on the floor engaging base frame for longitudinal sliding motion and an articulating upper frame mounted on the carriage.

A second embodiment of the present invention will now be described in conjunction with FIGS. 6–8. (It will be noted that the like components in all the embodiments are designated by like numerals.) The frame assembly 110 comprises a stand-alone floor engaging base frame 112 having longitudinally extending side rails 114, 116, transversely extending strut members 118–124 and four corner posts or legs 126 at four corners of the bed. This floor engaging base frame 112 will serve in place of the conventional bed frame discussed above. Decorative padded panels (not shown) may be suspended from the side and end rails of the bed to give it a desired appearance.

Figure 7:
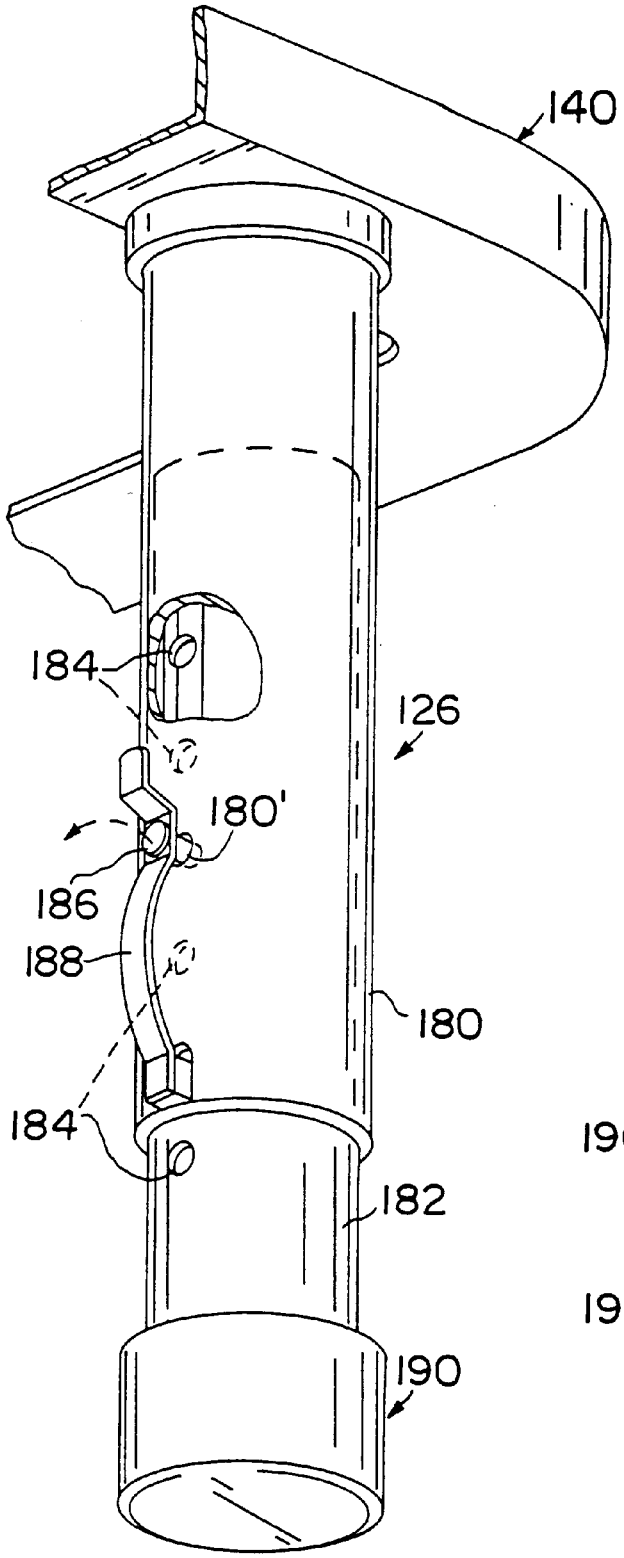
FIG. 7 is a perspective view showing a preferred leg assembly for the FIG. 6 frame assembly.
Figure 8:
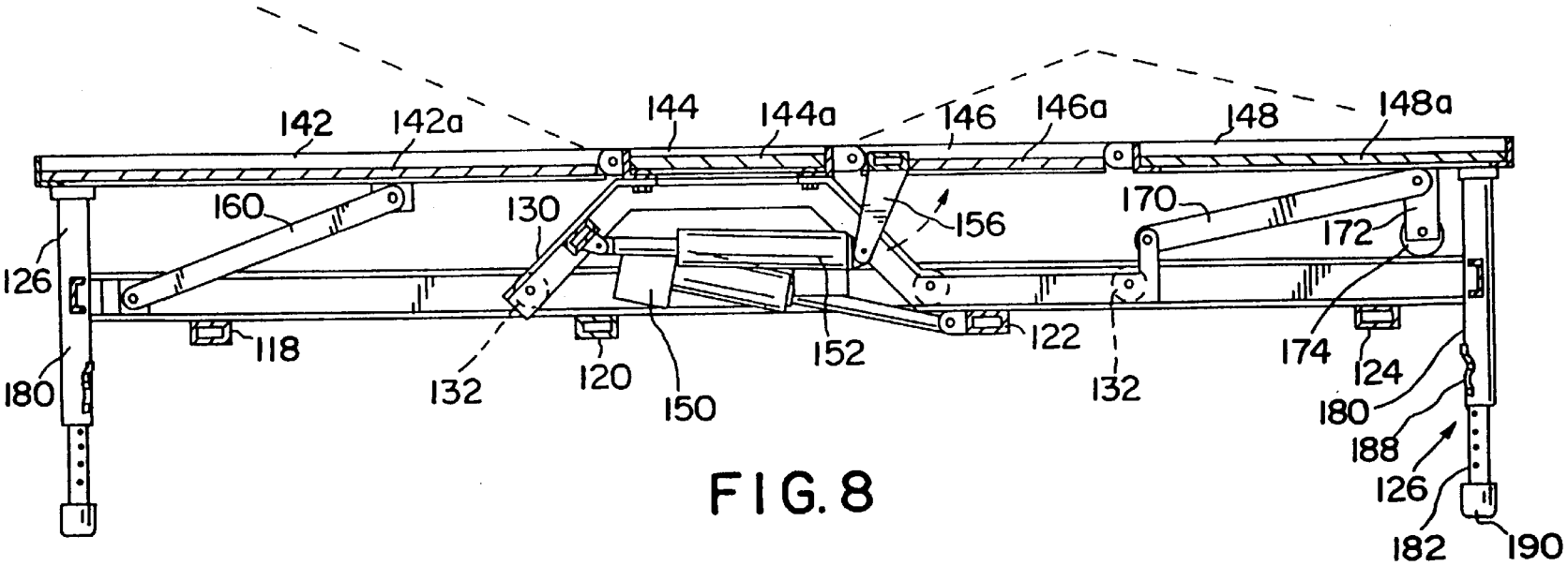
FIG. 8 is a sectional view, similar to FIG. 4, of the FIG. 6 frame assembly showing the articulating upper frame in the horizontal position.

The height adjustment mechanism is best seen in the perspective view of FIG. 7. Each leg 126 comprises an outer sleeve 180 rigidly attached to the floor engaging base frame 112 and a telescoping inner sleeve 182 which will move selectively downwardly to raise the elevation of the upper portion of the floor engaging base frame 112. Illustratively, the inner sleeve 182 may be provided with a series of vertically spaced openings 184. A selector pin 186 may be carried on a stiff leaf spring 188 to extend through an opening 180' in the outer sleeve 180 into one of the selected openings 184 in the inner sleeve 182. The lower end of the inner sleeve 182 may carry an isolation pad assembly 190.

Figure 7A:
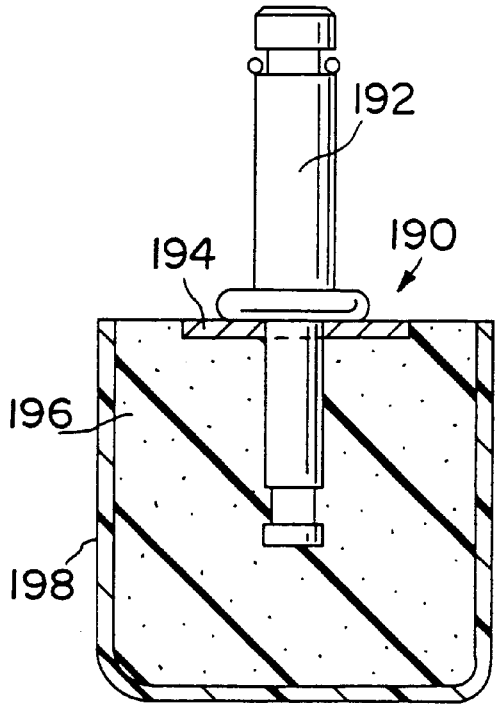
FIG. 7*a* is a cross-sectional view of an isolation pad for use with a mattress having a vibration massage capability.

The isolation pad assembly 190 isolates the floor engaging base frame 112 from the floor in case the user of the articulating frame energizes a vibrator mode on the mattress disposed on the frame. As illustrated in FIG. 7*a*, the isolation pad 190 includes a stem 192 secured to the inner sleeve 192, a load-bearing washer 194, elastomeric damping material 196 and a housing 198. The stem 192 and the load-bearing washer 194 may be made from a suitable high strength steel. The housing 198 may be made from a suitable high strength plastic. The elastomeric material 196 may be styrene butadiene rubber.

Once the floor engaging base frame 112 of the frame assembly 110 is carried into the residence of a purchaser, a carriage 130 and an articulating upper frame 140 (such as that shown and described in conjunction with FIGS. 1–5) may be mounted on the floor engaging base frame to provide the same features as those discussed in connection with FIGS. 1–5.

A third embodiment of the present invention is shown in FIGS. 9–12. The frame assembly 210 comprises a floor engaging base frame 212, a carriage 230 mounted on the base frame and an articulating upper deck 240 mounted on the carriage. In this embodiment, the floor engaging base frame 212 is disposed inside a conventional bed frame 200. The conventional bed frame 200 may include a headboard 202, a footboard 204, a pair of longitudinally extending side rails 206 interconnecting the headboard and footboard, and a pair of transversely extending strut members 208.

The floor engaging base frame 212 of the third embodiment, like the floor engaging base frame 112 of the second embodiment, comprises a pair of longitudinally extending sides 214, 216, a pair of longitudinally spaced and transversely extending strut members 218, 220 and four vertically-adjustable corner posts 226. The ends of the strut members 218, 220 are supported by the upwardly and inwardly opening side rails 206 of the conventional bed frame 200. The reception of the strut members 218, 220 in the side rails 206 of the bed frame 200 serves to stabilize the floor engaging base frame 212. In particular, it prevents the rotation and side-to-side motion of the floor engaging base frame 212 relative to the bed frame 200.

Figure 9:
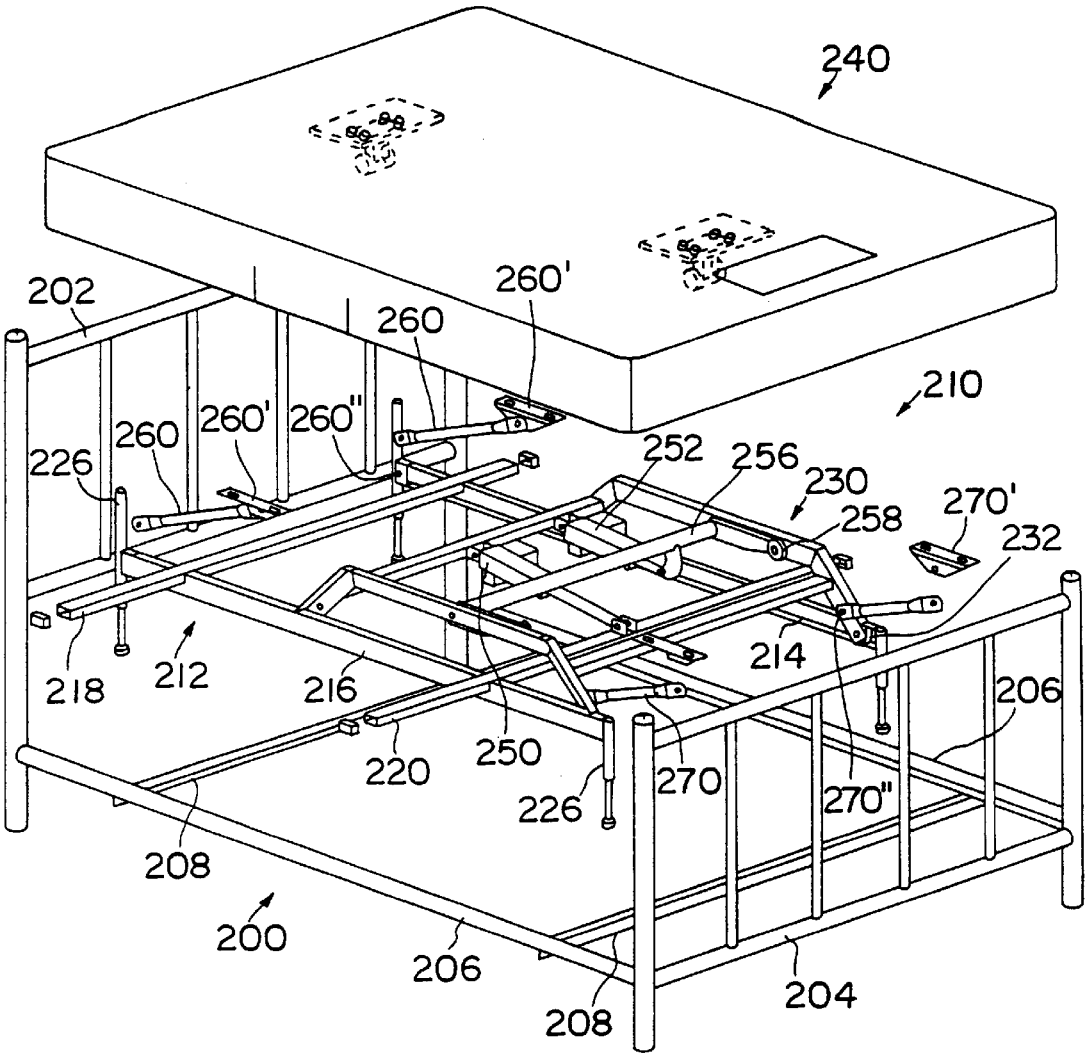
FIG. 9 is a top, right and front exploded perspective view of a third embodiment of the present invention showing a floor engaging base frame, similar to the FIG. 6 floor engaging base frame, but positioned inside the well formed by a conventional bed frame, a carriage mounted on the floor engaging base frame and an articulating upper deck mounted on the carriage.
Figure 9A:
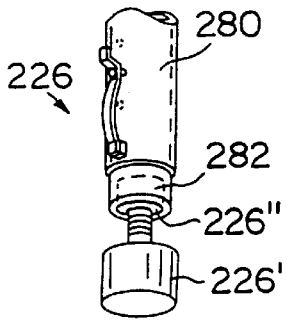
FIG. 9*a* is a perspective view showing an adjustable pad leveler attached to the corner posts of the floor engaging base frame of FIG. 9.

Typically, the beds in the consumer homes are of varying heights and of varying structural integrity. It is, therefore, desirable to equip the corner posts 226 with great flexibility for the height adjustment. To this end, as shown in FIG. 9*a*, the corner posts 226 are provided with threaded pad levelers 226'. The pad levelers 226' may be screwed into the tapped inserts 226" mounted inside the ends of the inner sleeves 282. The rest of the construction of the corner posts 226 is the same as the configuration shown in FIG. 7*a*. In operation, the struts 218, 220 rest on the side rails 206 of an existing bed frame 200 and the corner posts 226 are then adjusted so that the load of the person occupying the bed is transferred to the floor through the corner posts.

The rollers 232 mounted to the carriage 230 are received in the inwardly-opening channels of the side rails 214, 216 for supporting the rectilinear motion of the carriage. First and second drives 250, 252 are mounted on the carriage 230 for lifting and lowering the upper body section and the thigh section, respectively, of the articulating upper deck 240.

Figure 12:
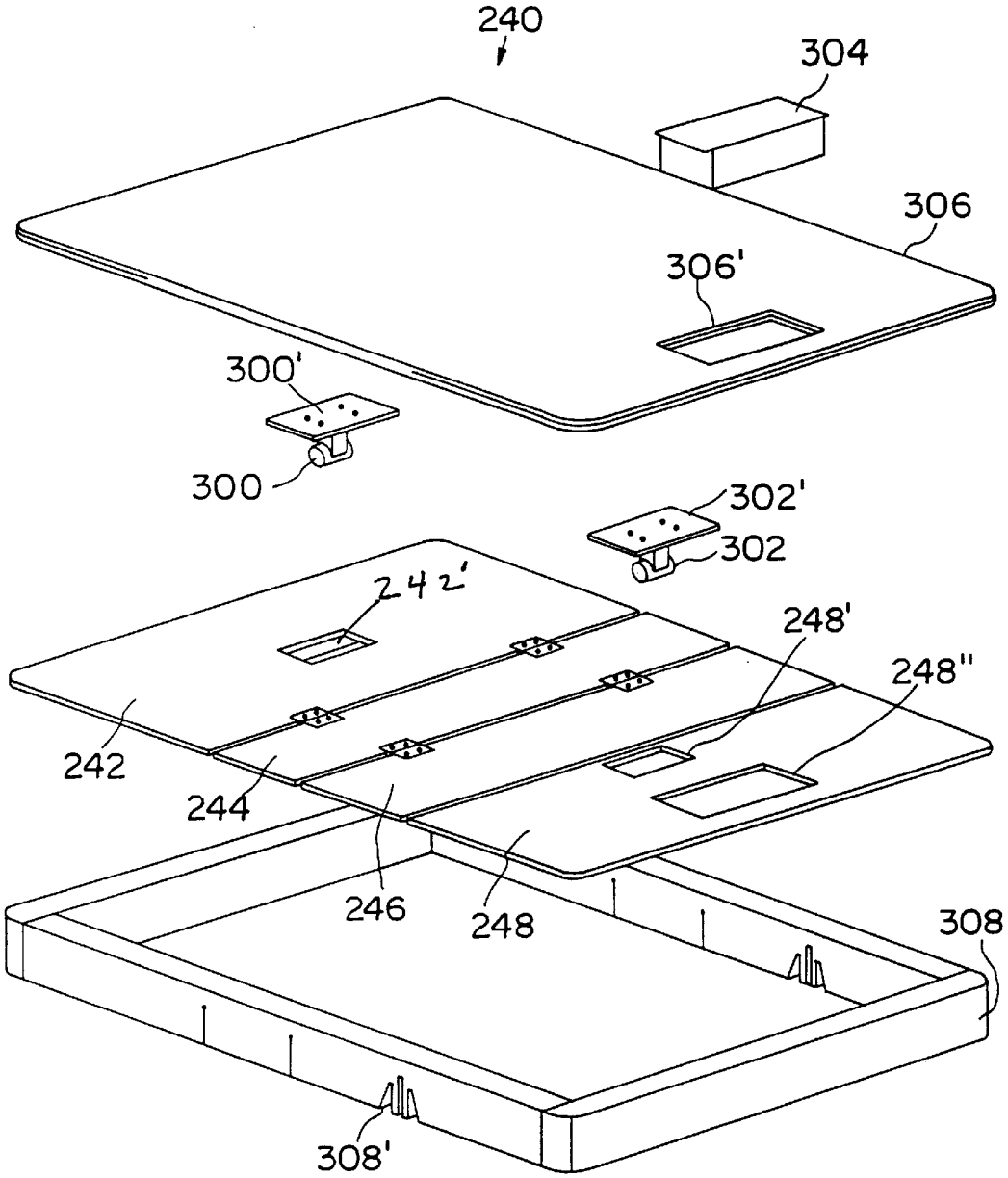
FIG. 12 is a partial exploded perspective view of the articulating upper deck, showing the four panel sections, a decorative skirt to be glued to the panel sections around the perimeter thereof, two massage units, a mattress pad and an electrical control box.

As shown in FIG. 12, the articulating upper deck 240 comprises an upper body panel section 242, a seat panel section 244, a thigh panel section 246 and a lower leg panel section 248. The longitudinally spaced, transversely extending panel sections 242–248 are hinged together to form a platform for the mattress and to provide articulating movement of the upper deck 240. The panel sections 242–248 are made from suitable high strength, light weight rigid material, such as an OSB board. It will be seen that this embodiment does away with separate frame elements used in the first two embodiments.

The upper body panel section 242 has an opening 242' for receiving a vibration massage unit 300 for the upper back portion of the body. The lower leg panel section 248, on the other hand, has two openings 248', 248"—one for receiving a leg massage unit 302 and the other for receiving an electrical control box 304, respectively. The massage units 300, 302 transmit vibrations to the person lying on the bed through the respective transmission boards 300', 302'. Any suitable mechanism, such as speaker coils, may be used for driving the massage units 300, 302. The electrical control box 304 houses the electronic circuits for controlling the operation of various electrical systems. A mattress pad 306, made from a resilient foam material, is disposed on the top of the panel sections 242–248 to cushion the feel of the deck. The vibrations from the massage units 300, 302 are transmitted to the person lying on the bed through the foam pad 306. The foam pad 306 additionally serves to reduce the effects of the vibrations on the bed frame.

The foam pad 306 has an opening 306' for providing access to the electrical control box 304 for inspection or repairs. The convenient location of the control box 304 on the lower leg panel section 248 provides easy access to the electronic circuits without having to turn the bed upside down when the repairs are needed.

A decorative padded shroud or skirt 308, also made from a resilient foam material, is glued around the perimeter of the panel sections 242–248. The foam shroud 308 serves to give the upper deck 240 a familiar box-spring like look. It also serves to conceal the mechanisms and electrical circuits disposed on the underside of the upper deck 240 and to reduce the risk of accident or injury. A plurality of slits 308' may be provided in the foam shroud 308 to allow it to bend easily when the upper body panel section 242 and the thigh panel section 246 are articulated.

First and second ends of the first drive 250 are pivotally secured to the carriage 230 and to the strut member 220, respectively. Similarly, the first and second ends of the second drive 252 are respectively secured to the carriage 230 and a lift arm bracket 256 pivotally mounted on the carriage.

Figure 10:
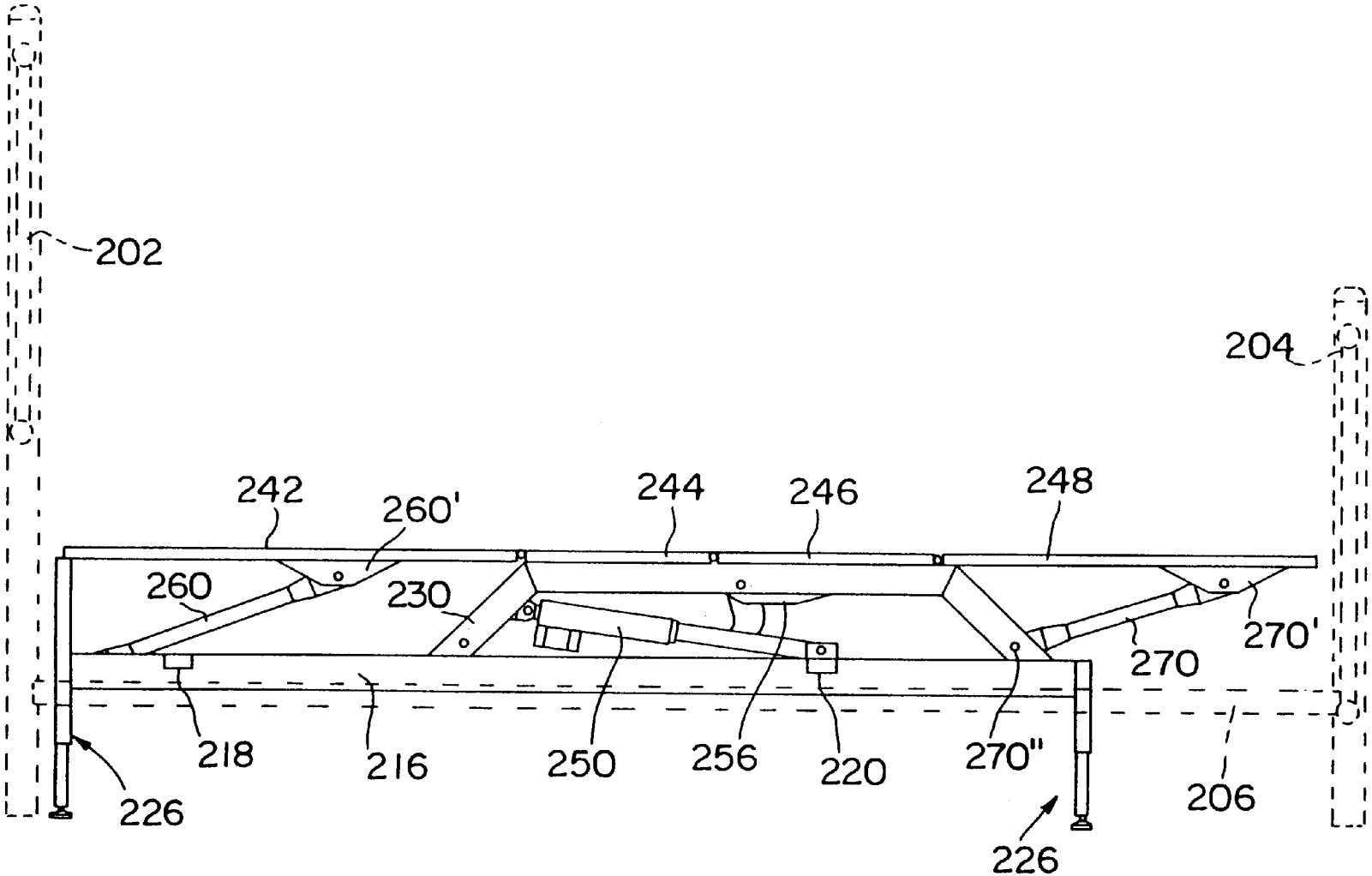
FIG. 10 is a front view, similar to FIGS. 4 and 8, of the FIG. 9 frame assembly showing the articulating upper deck in the horizontal position.
Figure 11:
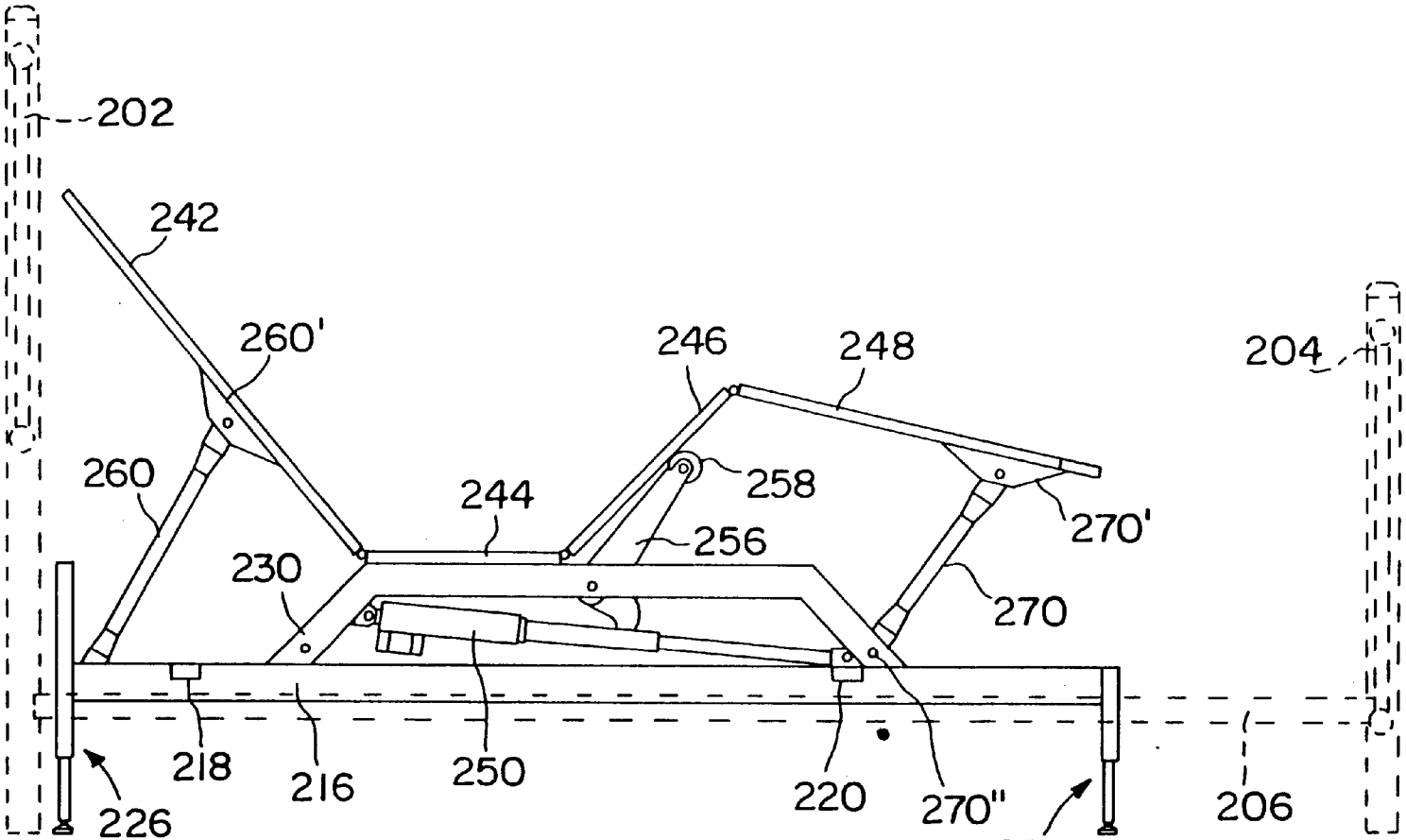
FIG. 11 is a front view, similar to FIG. 10, of the FIG. 9 frame assembly showing the upper body panel section and the thigh panel section in the raised position.

As shown in FIGS. 10 and 11, the upper body panel section 242 is pivotally connected by links 260 to the head ends of the side rails 214, 216 of the base frame 212. One end of each of the links 260 is pivotally connected to a bracket 260' fixedly mounted to the upper body panel section 242. The other end of each of the links 260 is pivotally secured to the respective one of the side rails 214, 216 by pins 260" (shown in FIG. 9). When the carriage 230 moves along the channels 214, 216 toward the headboard 202, the upper body panel section 242 is tilted upwardly from its horizontal position. The upper body panel section 242 is tilted downwardly toward its horizontal position when the carriage 230 moves toward the footboard 204. When the upper body panel section 242 is horizontal or flat, it rests on the two corner posts 226 disposed near the headboard 202.

When the second drive 252 is activated, it pivots the lift arm bracket 256 about its axis as shown in FIG. 11. When the lift arm bracket 256 is pivoted, a pair of rollers 258 secured to the arms of the lift arm bracket engage the underside of the thigh panel section 246 to tilt it upwardly. The lower leg panel section 246 is connected by links 270 to the carriage 230. One end of each of the links 270 is pivotally connected to a bracket 270' fixedly mounted to the lower leg panel section 248. The other end of each of the links 270 is pivotally secured to the carriage by pins 270". The links 270 are pivotally connected at their ends such that, when the thigh panel section 246 is raised, the lower leg panel section 248 is tilted downwardly, and such that, when the thigh panel section 246 is lowered, the lower leg panel section 248 is returned to its normal horizontal position.

Figure 13:
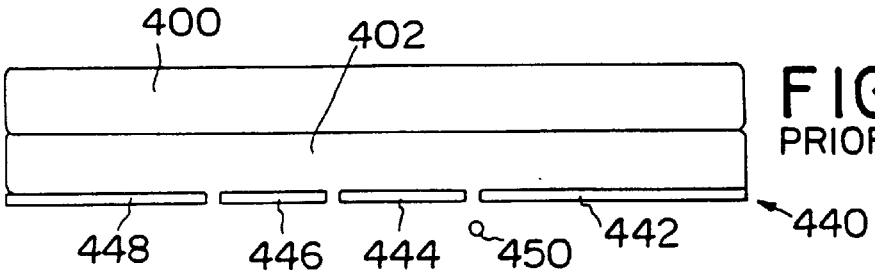
FIG. 13 PRIOR ART
FIGS. 13, 13*a* are diagrammatic views of the construction of a typical articulating upper deck, a foundation foam disposed on the upper deck and a mattress disposed on the foundation foam, and further showing the location of the pivot point for the upper body panel section.
Figure 13A:
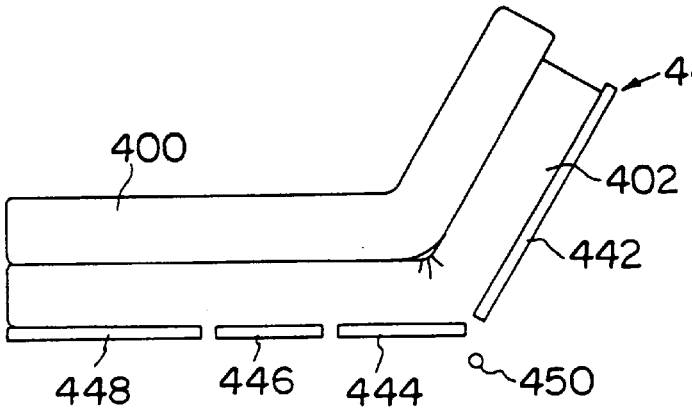
FIG. 13a PRIOR ART

Another feature of the present invention will now be described in conjunction with FIGS. 13, 13*a*, 14 and 14*a*. FIG. 13 illustrates the construction of a typical articulating bed. As shown, a mattress 400 lies on a foundation foam 402, which, in turn, lies on an articulating upper deck 440. The deck 440 is articulated about a pivot point 450 disposed under the deck through linkages (not shown). As shown in FIG. 13*a*, when the upper body panel section 442 is tilted upwardly, it rotates forward about the pivot point 450, thereby compressing the foundation foam 402 between the upper body panel section and the seat panel section 444. This causes the mattress 400 to extend beyond the foundation foam 402 and the upper body panel section 442 to, not only compromises the appearance, but also to generate wear, noise and static electricity.

Figure 14:
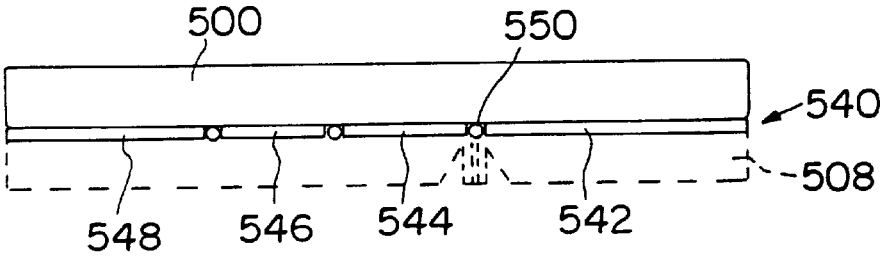
FIGS. 14, 14*a* are diagrammatic views of the construction of an articulating upper deck according to the present invention, a mattress disposed on the upper deck, and further showing the location of the in-line pivot point for the upper body panel section.
Figure 14A:
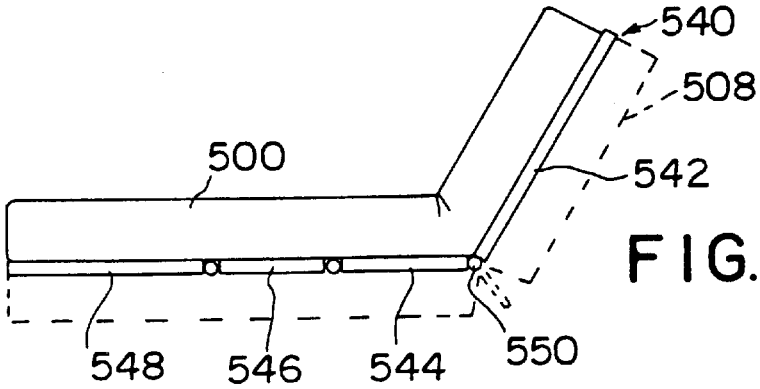

FIGS. 14, 14*a* demonstrate the construction of a bed assembly according to the present invention. As illustrated in FIG. 14, a mattress 500 lies on an articulating upper deck 540. Although not shown, a thin foam pad (like the one shown in FIG. 12) may be disposed between the deck 540 and the mattress 500. The deck 540 is articulated about an in-line pivot point 550 lying between the upper body panel section 542 and the seat panel section 544 ( instead of pivoting the upper deck about a pivot point disposed below the deck as shown in FIGS. 13, 13*a*). It is desirable to have the pivot point 550 as close as possible to the upper supporting surface of the deck 540. A decorative padded foam shroud 508 is glued around the perimeter of the panel sections 542–548. Thus, the foam shroud 508 is under the panel sections 542–548, not over it. As illustrated in FIG. 14*a*, when the upper body panel section 542 is tilted upwardly, it rotates about the in-line pivot point 550 without extending the mattress 500 beyond the upper body panel section 542.

It will be seen, therefore, that the articulating frame assembly (10, 110 or 210) of the present invention comprises a base frame (12, 112 or 212) onto which a carriage (30, 130 or 230), carrying the drive systems (50& 52, 150& 152 or 250& 252), is mounted. The carriage (30, 130 or 230) is slid into the channels (14& 16, 114& 116 or 214& 216) in the assembly process. The articulating upper frame (40, 140 or 240) is then mounted on the carriage (30, 130 or 230) by bolting the seat frame section (44, 144 or 244) to the carriage. The drive systems (50& 52, 150& 152 or 250& 252) and the links (60& 70, 160& 170 or 260& 270) are then hooked to the base frame (12, 112 or 212) and the articulating upper frame (40, 140 or 240). The pop-out panels (42*a*, 44*a*, 46*a*& 48*a* or 142*a*, 144*a*, 146*a*& 148*a*) are then dropped into the corresponding frame sections (42, 44, 46& 48 or 142, 144, 146& 148) in the first two embodiments. In the third embodiment, the frame sections (42, 44, 46& 48 or 142, 144, 146& 148) are eliminated and, instead, the panel sections (242, 244, 246& 248) are hinged together to form the articulating upper deck (240).

What is claimed is:

1. A bed frame comprising:

a) a base frame having a head end, a foot end, and opposite longitudinally extending sides connecting the head and foot ends, b) a carriage, c) an articulating frame comprising at least an upper body frame section and a seat frame section, the upper body and seat frame sections being longitudinally spaced apart and transversely extending with the upper body frame section being movable relative to the seat frame section to provide articulating movement thereof with respect to the seat frame section, d) the carriage being mounted on the base frame and shiftable longitudinally relative to the base frame, e) the articulating frame being mounted on the carriage, f) a first drive assembly connected between the base frame and the carriage, g) a first linkage assembly connected between the base frame and the upper body frame section, and h) the first drive assembly providing for longitudinal shifting of the carriage relative to the base frame and the first linkage assembly being responsive to the shifting of the carriage to provide articulating movement of the upper body frame section with respect to the seat frame section when the carriage shifts longitudinally.

2. The bed frame of claim 1 in which the first linkage assembly is connected between the upper body frame section and the base frame to cause the upper body frame section to tilt upwardly when the carriage shifts longitudinally toward the head end of the bed frame and to cause the upper body frame section to tilt downwardly when the carriage shifts longitudinally toward the foot end of the bed frame.

3. The bed frame of claim 2 further comprising support posts carried on the base frame to support the upper body frame section in its lowermost position such that the first linkage assembly lowers the upper body frame section onto the support posts when the carriage shifts toward the foot end of the bed frame.

4. The bed frame of claim 1 in which the carriage and the articulating frame are separable to be assembled upon delivery, the first drive assembly being configured to be mounted on one of the carriage and the base frame, and being further configured to be connected to the other of the carriage and the base frame during assembly.

5. The bed frame of claim 1 in which the carriage and the articulating frame are separable to be assembled upon delivery, the first linkage assembly being configured to be mounted on one of the upper body frame section and the base frame, and being further configured to be connected to the other of the upper body frame section and the base frame during assembly.

6. A method for upgrading a conventional bed including a conventional bed frame resting on a floor to an articulating bed including an articulating frame assembly, the method comprising the steps of providing a conventional bed including a conventional bed frame having four legs resting on the floor, providing an articulating bed including a floor-engaging articulating frame assembly, placing the floor-engaging articulating frame assembly inside the conventional bed frame resting on the floor, engaging the conventional bed frame with the articulating frame assembly, and engaging the floor with the floor-engaging articulating frame assembly independent of the conventional bed frame resting on the floor.

7. The method of claim 6, further including the step of providing the conventional bed frame with a headboard, a footboard and a pair of sides connecting the headboard and the footboard and defining an opening, and wherein the step of placing the articulating frame assembly inside the conventional bed frame includes the step of placing the articulating frame assembly inside the opening.

8. A method for upgrading a conventional bed including a conventional bed frame resting on a floor to an articulating bed including an articulating frame assembly, the method comprising the steps of providing a conventional bed including a conventional bed frame, providing an articulating bed including a floor-engaging articulating frame assembly, providing the articulating frame assembly with a corner post, placing the articulating frame assembly inside the conventional bed frame, engaging the conventional bed frame with the articulating frame assembly, and lowering the corner post of the articulating frame assembly to engage the floor.

9. The method of claim 8, further including the step of providing the articulating frame assembly with a strut member, and wherein the step of engaging the conventional bed frame with the articulating frame assembly further includes the step of engaging the conventional bed frame with the strut member.

10. A method for upgrading a conventional bed including a conventional bed frame resting on a floor to an articulating bed including an articulating frame assembly, the method comprising the steps of providing a conventional bed including a conventional bed frame, providing an articulating bed including an articulating frame assembly comprising a floor-engaging base frame, a carriage configured to be translatable longitudinally relative to the base frame, and an articulating upper frame configured to be mounted on the carriage, placing the articulating frame assembly inside the conventional bed frame, engaging the conventional bed frame with the articulating frame assembly, and engaging the floor with the articulating frame assembly, wherein the placing step further includes the steps of placing the floor-engaging base frame inside the conventional bed frame, mounting the carriage on the base frame, and mounting the articulating upper frame on the carriage for translation therewith.

11. The method of claim 10, further including the steps of providing the base frame with corner posts for adjusting the height of the base frame relative to the floor and providing the base frame with transverse strut members, wherein the step of engaging the conventional bed frame with the articulating frame assembly includes the steps of engaging the conventional bed frame with the strut members, and wherein the step of engaging the floor with the articulating frame assembly includes the step of adjusting the height of the base frame so that a load supported by the base frame is transferred to the floor through the corner posts.

12. The method of claim 10, further including the step of providing the carriage with a roller and the base frame with a side rail defining a channel, and the step of mounting the carriage on the base frame further includes the step of placing the roller of the carriage in the channel defined by the side rail.

13. The method of claim 10, further including the step of providing a drive mounted on the base frame, and wherein the step of mounting the carriage on the base frame further includes the step of coupling the drive mounted on the base frame to the carriage.

14. The method of claim 10, further including the step of providing a drive mounted on the carriage, and wherein the step of mounting the carriage on the base frame further includes the step of coupling the drive mounted on the carriage to the base frame.

15. The method of claim 10, further including the step of providing a link coupled to the articulating upper frame, and wherein the step of mounting the articulating upper frame on the carriage includes the step of coupling the link coupled to the articulating upper frame to the base frame.

16. The method of claim 10, further including the step of providing a link coupled to the base frame, and wherein the step of mounting the articulating upper frame on the carriage includes the step of coupling the link coupled to the base frame to the articulating upper frame.

17. A bed assembly comprising:

a) a base, b) a frame supported by the base, c) a deck supported by the frame and including an upwardly-facing top surface and an edge defining a perimeter of the deck, and d) a resilient shroud connected adjacent the perimeter of the deck and extending downwardly therefrom below the upwardly-facing top surface of the deck.

18. The bed assembly of claim 17, wherein the deck includes a panel section having an edge defining a portion of the edge of the deck and the shroud is fastened to the edge of the panel section.

19. The bed assembly of claim 17, wherein the shroud includes foam material.

20. The bed assembly of claim 17, wherein the shroud is decorated so that it has the appearance of a box spring.

21. The bed assembly of claim 17, wherein the deck includes at least an upper body frame section and a seat frame section, the upper body and seat frame section being longitudinally spaced apart and transversely extending with the upper body frame section being movable relative to the seat frame section to provide articulating movement thereof with respect to the seat frame section.

22. A bed assembly comprising:

a) a base, b) a frame supported by the base, c) an articulating deck supported by the frame and defining an upwardly-facing top surface and a downwardly-facing bottom surface, the articulating deck including at least an upper body panel section and a seat panel section, d) a hinge connecting the upper body panel section to the seat panel section so that the upper body panel section can articulate relative to the seat panel section, and e) a mattress supported directly on the upwardly-facing top surface of the articulating deck so that an upper body portion of the mattress articulates relative to a seat portion of the mattress when the upper body panel section articulates relative to the seat panel section.

23. The bed assembly of claim 22, wherein the hinge defines a pivot axis positioned to lie adjacent a plane defined by the top surface of the deck.

24. The bed assembly of claim 22, wherein the hinge defines a pivot axis positioned to lie above a plane defined by the bottom surface of the deck.

25. The bed assembly of claim 22, wherein the hinge defines a pivot axis positioned to lie between the upper body panel section and the seat panel section.

* * * * *